US005676581A

United States Patent [19]

Ziegler

[11] Patent Number: 5,676,581

[45] Date of Patent: Oct. 14, 1997

[54] DEFORMABLE FLYING TOY

[76] Inventor: Scott W. Ziegler, 932 Vista del Monte Way, El Cajon, Calif. 92020

[21] Appl. No.: 601,183

[22] Filed: Feb. 14, 1996

[51] Int. Cl.[6] ..... A63H 27/00; A63B 65/00

[52] U.S. Cl. ..... 446/46; 446/240

[58] Field of Search ..... 446/46–48, 236, 446/240; 273/424, 428; D21/85, 86

[56] References Cited

U.S. PATENT DOCUMENTS

| | | | |
|---|---|---|---|
| D. 337,623 | 7/1993 | Franker | D21/86 |
| 2,109,788 | 3/1938 | Worst | 446/240 |
| 4,031,655 | 6/1977 | Ponciano et al. | 446/52 |
| 4,212,131 | 7/1980 | Ross, Jr. | 446/74 D |
| 4,223,473 | 9/1980 | Brown | 446/74 D |
| 4,241,533 | 12/1980 | Newsome | 446/74 D |
| 4,709,928 | 12/1987 | Willingham | 273/309 |
| 4,737,128 | 4/1988 | Moormann et al. | 446/46 |
| 5,382,027 | 1/1995 | Eatherly | 273/424 X |
| 5,476,405 | 12/1995 | Clayborne | 446/236 |

FOREIGN PATENT DOCUMENTS

| | | |
|---|---|---|
| 2-076-671 | 5/1981 | United Kingdom . |
| 2-187-969 | 3/1987 | United Kingdom . |
| 2-250-212 | 10/1990 | United Kingdom . |

*Primary Examiner*—Mickey Yu
*Attorney, Agent, or Firm*—Rodney F. Brown

[57] ABSTRACT

A flying toy is provided having a substantially planar, flexibly deformable body with a top surface, a bottom surface and a peripheral edge. A plurality of protuberances are disposed on the top surface of the body spaced a radial distance apart relative to the body. The protuberances have a hollow configuration defining a concavity open to the bottom surface of the body. The protuberances and body are integrally formed from a sheet of a substantially continuous flexibly deformable material. The configuration of the flying toy provides it with aerodynamic properties when thrown with a rotational motion in a planar orientation.

9 Claims, 2 Drawing Sheets

DEFORMABLE FLYING TOY

TECHNICAL FIELD

The present invention relates generally to toys, and more particularly to a toy that is flexibly deformable, yet aerodynamically configured to fly when thrown with a rotational motion.

BACKGROUND OF THE INVENTION

Disk-shaped toys having an aerodynamic configuration enabling them to fly when thrown with a certain orientation by the user are generally known. The most common of these flying toys is a substantially rigid disk available under the trade name "FRISBEE." The disk has a relatively flat topside and a scooped out bottomside that provides the disk with aerodynamic lift when the disk is thrown with a rotational motion in a planar orientation. Thus, when properly thrown, the disk is able to glide and soar for the amusement and sport of the user. With well-developed throwing skills, the user is able to exert a high degree of control over the flight characteristics of the disk.

Others have developed disk-shaped flying toys that are flexible rather than rigid, as exemplified by U.S. Pat. No. 4,241,533 and UK Patent Application 2 076 671 A. Flexible disk-shaped flying toys, however, are far less accepted than rigid disk-shaped flying toys because the prior art flexible flying toys do not have satisfactory flight or handling characteristics. Therefore, a need exists for a flexible flying toy having satisfactory flight and handling characteristics. Accordingly, it is an object of the present invention to provide a flying toy that is flexibly deformable. It is a further object of the present invention to provide a flexible flying toy that maintains satisfactory aerodynamic performance as it flexibly deforms in flight. It is still another object of the present invention to provide a flexible flying toy that has satisfactory handling characteristics for the user. It is yet another object of the present invention to provide a flexible flying toy that is suitable for the amusement and sport of the user. These objects and others are accomplished in accordance with the invention described hereafter.

SUMMARY OF THE INVENTION

The present invention is a flying toy comprising a substantially planar deformable body having a top surface, a bottom surface and a peripheral edge. A plurality of protuberances are disposed on the top surface of the body spaced a radial distance apart relative to the body.

In a preferred embodiment, the protuberances are arranged in a pattern of concentric rings about the center of the top surface of the body and the protuberances are substantially equidistantly spaced relative to one another. Each of the protuberances is configured in the shape of a hollow cone. The base of the cone is integrally formed with the body such that the cone defines a concavity open to the bottom surface of the body. The protuberances and body are integrally formed from a sheet of a substantially continuous flexibly deformable material, such as an elastomeric material.

The flying toy of the present invention will be further understood from the drawings and the following detailed description.

DESCRIPTION OF PREFERRED EMBODIMENTS

Figure 1:
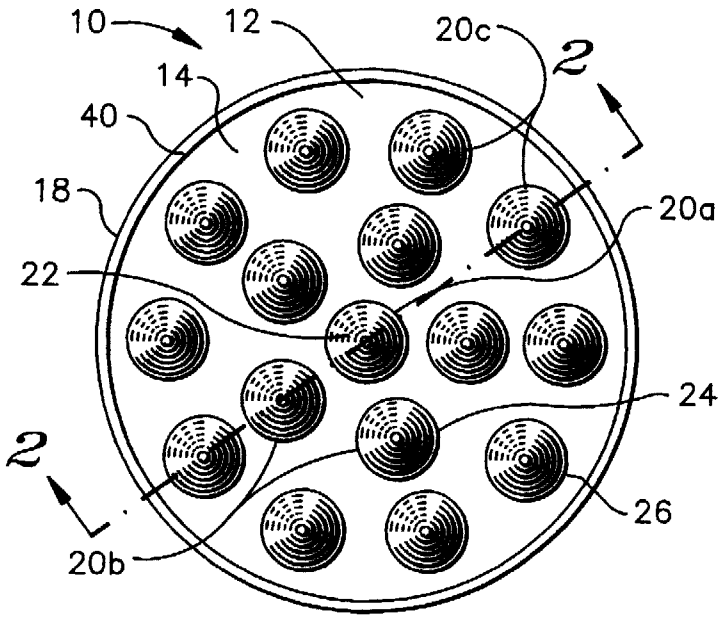
FIG. 1 is a top plan view of the flying toy of the present invention supported on a flat surface.
Figure 2:
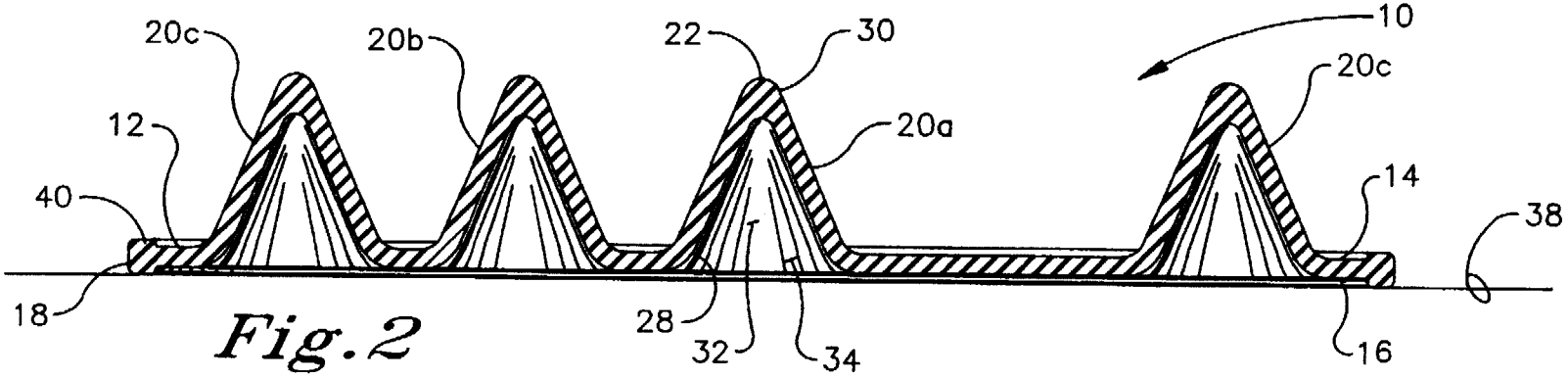
FIG. 2 is a cross-sectional elevational view along line 2—2 of the flying toy of FIG. 1.
Figure 3:
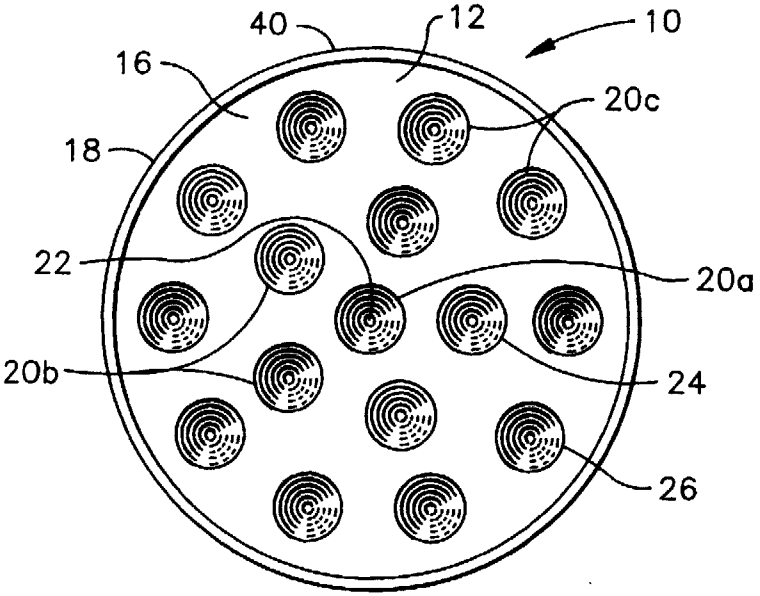
FIG. 3 is a bottom plan view of the flying toy of FIG. 1.

Referring initially to FIGS. 1, 2 and 3, the flying toy of the present invention is shown and generally designated 10. The flying toy 10 comprises a body 12 configured in the shape of a substantially planar disk. The body 12 has a top surface 14, a bottom surface 16, and a peripheral edge 18. Disposed on the top surface 14 are a plurality of protuberances 20*a*, 20*b*, 20*c*. The protuberances 20*a*, 20*b*, 20*c* are arranged in a pattern of concentric rings increasing in radial distance from the center point 22 of the top surface 14, with protuberance 20*a* being positioned at the center point 22, protuberances 20*b* forming the radially inner ring 24 and protuberances 20*c* forming the radially outer ring 26. Each protuberance 20*a*, 20*b*, 20*c* is spaced substantially equidistant relative to the adjacent protuberances 20*a*, 20*b*, 20*c*.

The pattern of protuberances shown and described herein is but one embodiment of the present invention, it being understood that the invention is not limited to any one such pattern of protuberances and that other patterns are possible within the purview of the skilled artisan to the extent the selected pattern of protuberances satisfies the performance criteria of the flying toy 10 set forth herein. Nevertheless, it is preferred that the selected pattern include at least two protuberances spaced a radial distance apart relative to the center point 22 of the top surface 14.

Each of the protuberances 20*a*, 20*b*, 20*c* shown in FIG. 1 is substantially identically configured. Thus, the protuberance configuration is described with reference to the protuberance 20*a*, it being understood that this description is applicable to all of the protuberances 20*a*, 20*b*, 20*c*. The conical protuberance 20*a* is configured in the shape of an open-bottomed hollow cone having a base 28 that is in coplanar alignment with the body 12 and an apex 30 that is positioned above the body 12. The hollow protuberance 20*a* defines a concavity 32 having an opening 34 on the bottom surface 16 of the body 12.

The protuberance configuration shown and described herein is also but one embodiment of the present invention, it being further understood that the invention is not limited to any one such protuberance configuration and that other configurations are possible within the purview of the skilled artisan to the extent the selected configuration satisfies the performance criteria of the flying toy 10 set forth herein. Nevertheless, it is preferred that the selected configuration provide the protuberance with a shape extending above the top surface 14 of the body 12 and a concavity opening to the bottom surface 16 of the body 12. As such, hemispherical, cubical and pyramid shaped protuberances, to name a few alternate shapes readily apparent to the skilled artisan, are within the scope of the present invention, although not shown herein.

Figure 4:
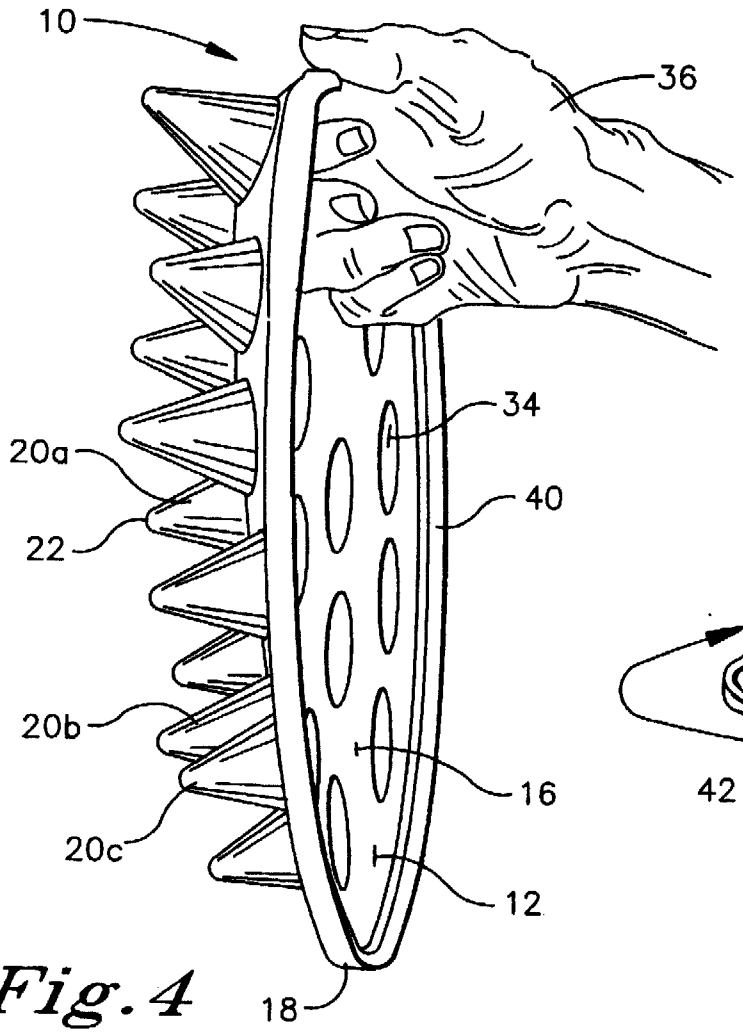
FIG. 4 is a perspective view of the flying toy of the present invention grasped in the hand of a user.

The flying toy 10 is characterized as being flexibly deformable. In particular, the flying toy 10 has a completely floppy character, lacking any structural stiffness. Accordingly, the structure of the flying toy 10 is insufficient to support its own weight when suspended in a static position, such as when being held in the grasp of a user's hand 36 as shown with reference to FIG. 4. In contrast, the flying toy 10 is depicted in FIGS. 1–3 as spread out upon a flat rigid surface 38, such as a table top that fully supports the flat planar configuration of the body 12. To achieve a desired floppy character, the body 12 and protuberances 20*a*, 20*b*, 20*c* of the flying toy 10 are preferably integrally constructed as a continuous unitary sheet of flexible material, wherein the bases 28 of the protuberances 20*a*, 20*b*, 20*c* are integral with the body 12 of the flying toy 10. A desirable material of construction for the flying toy 10 is an elastomeric material, such as a natural or synthetic rubber or plastic, as for example used in the construction of conventional rubber gloves. Preferred among these materials of construction is a soft, pliant, stretchable PVC having a durometer value between about 35 and about 45. The preferred material is relatively dense, providing the flying toy 10 with sufficient weight to reduce the negative effect of a breeze on the flight characteristics of the flying toy 10.

One means of construction is to mold the PVC or other elastomeric material into the desired configuration of the flying toy 10 in accordance with techniques conventional to the skilled artisan. The molded construction of the flying toy 10 typically provides a narrow ridge 40 along the peripheral edge 18 of the body 12. It is noted, however, that the ridge 40 is merely incident to the molding process and, like the other components of the flying toy 10, has a floppy character that does contribute any significant structural stiffness to the flying toy 10.

Figure 5:
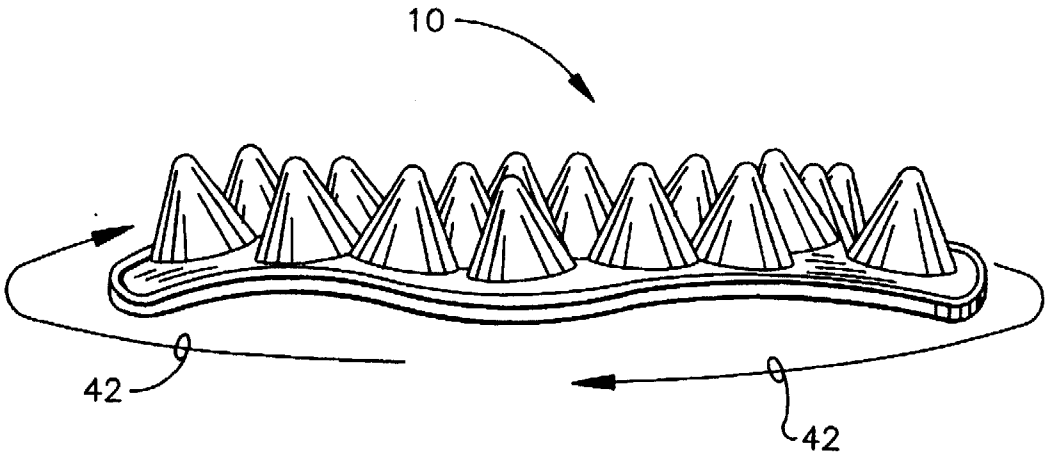
FIG. 5 is a perspective view of the flying toy of the present invention in flight.

The primary functions of the flying toy 10 are that of amusement, recreation and sport, such as for playing various games of catch, as are well known to users of conventional flying disks available under the mark "FRISBEE." The configuration of the multiple protuberances 20*a*, 20*b*, 20*c* and the flexibly deformable nature of the flying toy 10, however, provide the present flying toy 10 with unique attributes for throwing, flight and catching. Although the present invention is not limited to any specific mechanism of operation, it is believed that the configuration and rotation of the flying toy 10 provide it with aerodynamic lift when the flying toy 10 is thrown in a planar orientation with a rotational motion as depicted by the arrows 42 shown in FIG. 5. The rotational motion of the flying toy 10 creates a centrifugal force directed radially outward from the center point 22 that tends to flatten out the deformable body 12 giving it a more planar configuration in flight than when statically suspended, thereby enabling the flying toy 10 to glide and soar as a function of the aerodynamic lift. The flying toy 10 nevertheless exhibits some oscillatory motion in flight due to its flexible deformation characteristics that contribute an added degree of challenge to games of catch played with the flying toy 10. It is further noted that the openings 34 and concavities 32 of the protuberances 20*a*, 20*b*, 20*c* can serve as finger holes for the user when throwing or catching the flying toy 10, thereby providing further variations to games of catch played with the flying toy 10. The flexibly deformable character of the flying toy 10 also enables the user to collapse the toy 10 to a balled configuration during handling, such as when catching the toy 10 or when transporting or storing the toy 10. The flying toy 10 readily returns to its planar configuration when released.

While forgoing preferred embodiments of the invention have been described and shown, it is understood that alternatives and modifications, such as those suggested and others, may be made thereto and fall within the scope of the invention.

I claim:

1. A flying toy comprising:

a substantially planar deformable body having a top surface, a bottom surface and a peripheral edge wherein said body is formed from an elastomeric material; and a plurality of protuberances formed from said elastomeric material and disposed across substantially the entirety of said top surface of said body, wherein said protuberances define a plurality of corresponding concavities open to said bottom surface of said body and disposed across substantially the entirety of said bottom surface, each of said concavities being sufficiently sized to receive at least a substantial portion of a finger of a user of said flying toy.

2. A flying toy as recited in claim 1, wherein said protuberances are arranged on said top surface of said body about a plurality of concentric ring patterns.

3. A flying toy as recited in claim 1, wherein each of said protuberances has a conical shape.

4. A flying toy as recited in claim 1, wherein each of said protuberances has a base integrally formed with said body.

5. A flying toy as recited in claim 1, wherein each of said protuberances is substantially hollow.

6. A flying toy as recited in claim 1, wherein said protuberances and said body are integrally formed from a sheet of said elastomeric material.

7. A flying toy comprising:

a substantially planar deformable body having a top surface, a bottom surface and a peripheral edge; and a plurality of protuberances disposed across substantially the entirety of said top surface of said body arranged in a plurality of concentric ring patterns, wherein said protuberances and said body are integrally formed from a sheet of an elastomeric material and further wherein said protuberances define a plurality of corresponding concavities open to said bottom surface of said body and disposed across substantially the entirety of said bottom surface, each of said concavities being sufficiently sized to receive at least a substantial portion of a finger of a user of said flying toy.

8. A flying toy as recited in claim 7, wherein each of said protuberances has a conical shape.

9. A flying toy as recited in claim 7, wherein each of said protuberances is substantially hollow.

* * * * *